US007387376B2

(12) United States Patent
Murakami et al.

(10) Patent No.: US 7,387,376 B2
(45) Date of Patent: Jun. 17, 2008

(54) LIQUID DROPLET EJECTING UNIT, IMAGE FORMING APPARATUS AND VALVE

(75) Inventors: Atsushi Murakami, Ebina (JP); Kishiharu Itazu, Ebina (JP); Kohei Murakami, Ebina (JP); Masashi Hiratsuka, Ebina (JP); Katsushi Amarume, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 453 days.

(21) Appl. No.: 11/220,990

(22) Filed: Sep. 7, 2005

(65) Prior Publication Data

US 2006/0197812 A1 Sep. 7, 2006

(30) Foreign Application Priority Data

Mar. 3, 2005 (JP) ..... 2005-059365

(51) Int. Cl.
*B41J 2/17* (2006.01)
*B41J 2/175* (2006.01)

(52) U.S. Cl. ..... 347/84; 347/85

(58) Field of Classification Search ..... 347/84, 347/87, 30; 422/100; 417/413.3; 604/247; 137/513.7

See application file for complete search history.

(56) References Cited

U.S. PATENT DOCUMENTS 4,086,060 A * 4/1978 Hermann, Jr. ..... 422/100
4,911,616 A * 3/1990 Laumann, Jr. ..... 417/413.3
4,931,812 A * 6/1990 Dunn et al. ..... 347/87
4,950,254 A * 8/1990 Andersen et al. ..... 604/247
5,529,091 A * 6/1996 Anderson ..... 137/513.7
6,193,356 B1 * 2/2001 Takata ..... 347/30
2006/0152558 A1 * 7/2006 Hoisington ..... 347/84

FOREIGN PATENT DOCUMENTS

JP 4-341854 11/1992
JP 2002-307716 10/2002
JP 2004-58675 2/2004

* cited by examiner

*Primary Examiner*—Stephen D Meier
*Assistant Examiner*—Carlos A Martinez, Jr.
(74) *Attorney, Agent, or Firm*—Fildes & Outland, P.C.

(57) ABSTRACT

A liquid droplet ejecting unit is disclosed wherein plural liquid droplet ejecting sub-units are provided which are arrayed in a direction substantially perpendicular to a conveying direction of a recording medium. Further, plural valves are provided which connect the respective liquid droplet ejecting sub-units and a liquid feed path. The valves comprise a valve body having an inlet port and an outlet port, and a floating member. The floating member is larger in radius than the inlet port and smaller in radius than the outlet port and has a lower specific gravity that the liquid. Thus, the floating member is floated in the liquid in the valve body and capable of closing the inlet port. An image forming apparatus using such a liquid droplet ejecting unit is also disclosed.

14 Claims, 13 Drawing Sheets

| | FORWARD DIRECTION | BACKWARD DIRECTION |
|---|---|---|
| FLOW PATH RESISTANCE [N・sec/m$^5$] | ≒0 | $4.0\times10^{11}$ |

LIQUID DROPLET EJECTING UNIT, IMAGE FORMING APPARATUS AND VALVE

CROSS-REFERENCE TO RELATED APPLICATION

This application claims priority under 35 USC 119 from Japanese Patent Application No. 2005-59365, the disclosure of which is incorporated by reference herein.

BACKGROUND OF THE INVENTION

1. Field of the Invention

The present invention generally relates to an image forming technique. More particularly, the present invention pertains to a liquid droplet ejecting unit in which plural liquid droplet ejecting sub-units that eject droplets of a liquid fed through a common liquid feed path from nozzles onto a recording medium are arrayed in a direction perpendicular to the conveying direction of the recording medium; an image forming apparatus including this liquid droplet ejecting unit; and a valve that is provided in a vertically extending liquid flow path along which the liquid is fed downward.

2. Description of the Related Art

A structure has conventionally been devised in which a long inkjet recording unit (liquid droplet effecting unit) having a recording region of the width of a recording medium or longer (the length in a direction perpendicular to the conveying direction of the recording medium) and plural short sub-units (liquid droplet ejecting sub-units) having a recording region shorter than the width of the recording medium are arrayed in the widthwise direction of the recording medium.

In the above structure, when the sub-units are connected together via a common ink feed path and a suctioning operation for suctioning the ink from the nozzles is performed on a per sub-unit basis, there is a tendency that a suctioning pressure acts on the remaining sub-units in which no suctioning operation is performed, via the ink feed path. For this reason, a negative pressure occurs due to the ink being caused to flow backward in the remaining sub-units in which no suctioning operation is performed, and thus air is suctioned from the nozzles so that air bubbles are formed, whereby a satisfactory resumption action is prevented.

It has conventionally been proposed to provide a check valve at the ink feed port of an inkjet recording head unit (for example refer to JP-A No. 2002-307716, JP-A No. 4-341854, and JP-A No. 2004-58675). Therefore, in the above-mentioned structure, it might be imagined that formation of air bubbles could be prevented by providing a check valve at the ink feed port of each sub-unit so as to prevent the ink from being caused to flow backward in the other sub-units.

However, in the above-mentioned JP-A No. 2002-307716, JP-A No. 4-341854, and JP-A No. 2004-58675, the specific gravity of a spherical member that opens and closes the check valve is selected to be about equal to that of the ink. For this reason, the spherical member remains submerged in the ink except during a suctioning operation, and after the suctioning operation is started, the spherical member is displaced in following the flow of the ink so as to close the check valve. Obviously, this check valve has poor readiness of the checking operation. Thus, a time lag occurs between when the suctioning operation is started and when the check valve is closed, and there is a problem such that air bubbles occur as a result of ink flowing backward during the time lag.

Meanwhile, it is possible to improve the readiness of the check valve for the checking operation by previously causing the spherical member to be biased in the direction of backward flow of the ink, by means of a spring or the like, as in the case of an ordinary check valve. However, in such a case, there is another problem that an increased pressure loss is caused due to an increase in the load of an opening operation when the ink is fed in a normal direction.

SUMMARY OF THE INVENTION

The present invention has been made in view of the above facts and the need to improve the readiness of a valve for the checking operation when a liquid flows backward, without being accompanied by an increased pressure loss during an opening operation of the valve when the liquid flows backward.

A first aspect of the present invention provides a liquid droplet ejecting unit comprising: plural liquid droplet ejecting sub-units arrayed in a direction substantially perpendicular to a conveying direction of a recording medium, each of the liquid droplet ejecting sub-units being structured such that a liquid is fed thereto via a common liquid feed path and droplets of the liquid are ejected from nozzles onto the recording medium; and plural valves that connect the respective liquid droplet ejecting sub-units and the liquid feed path; wherein each of the valves comprises a valve body provided at an upper side with an inlet port into which the liquid flows from the liquid feed path, and at a lower side with an outlet port from which the liquid that flows into the inlet port from the liquid feed path flows out to the liquid droplet ejecting sub-unit, the outlet port being larger in cross-sectional size than the inlet port; and a floating member that is larger in cross-sectional size than the inlet port and smaller in cross-sectional size than the outlet port and has a lower specific gravity that the liquid such that the floating member floats in the liquid in the valve body and is capable of closing the inlet port.

A second aspect of the present invention provides an image forming apparatus comprising a liquid droplet ejecting unit which comprises: plural liquid droplet ejecting sub-units arrayed in a direction substantially perpendicular to a conveying direction of a recording medium, each of the liquid droplet ejecting sub-units being structured such that a liquid is fed thereto via a common liquid feed path and droplets of the liquid are ejected from nozzles onto the recording medium; and plural valves that connect the respective liquid droplet ejecting sub-units and the liquid feed path; wherein each of the valves comprises a valve body provided at an upper side with an inlet port into which the liquid flows from the liquid feed path and at a lower side with an outlet port from which the liquid that flows into the inlet port from the liquid feed path flows out to the liquid droplet ejecting sub-unit, the outlet port being larger in cross-sectional size than the inlet port, and a floating member that is larger in cross-sectional size than the inlet port and smaller in cross-sectional size than the outlet port and has a lower specific gravity that the liquid such that the floating member is floated in the liquid in the valve body and capable of closing the inlet port.

A third aspect of the present invention provides a valve comprising: a valve body provided in a substantially vertically extending liquid flow path that permits a liquid to flow downward and configured such that an inlet port into which the liquid flows from the liquid flow path is smaller in cross-sectional size than an outlet port from which the liquid that flows into the inlet port flows out; and a floating member that is larger in cross-sectional size than the inlet port and smaller in cross-sectional size than the outlet port and has a lower specific gravity that the liquid such that the floating member floats in the liquid in the valve body and is capable of closing the inlet port.

Other aspects, features and advantages of the present invention will become apparent from the following description taken in conjunction with the accompanying drawings.

BRIEF DESCRIPTION OF THE DRAWINGS

Preferred embodiments of the present invention will be described in detail based on the following figures, in which.

DETAILED DESCRIPTION OF THE INVENTION

Figure 1:
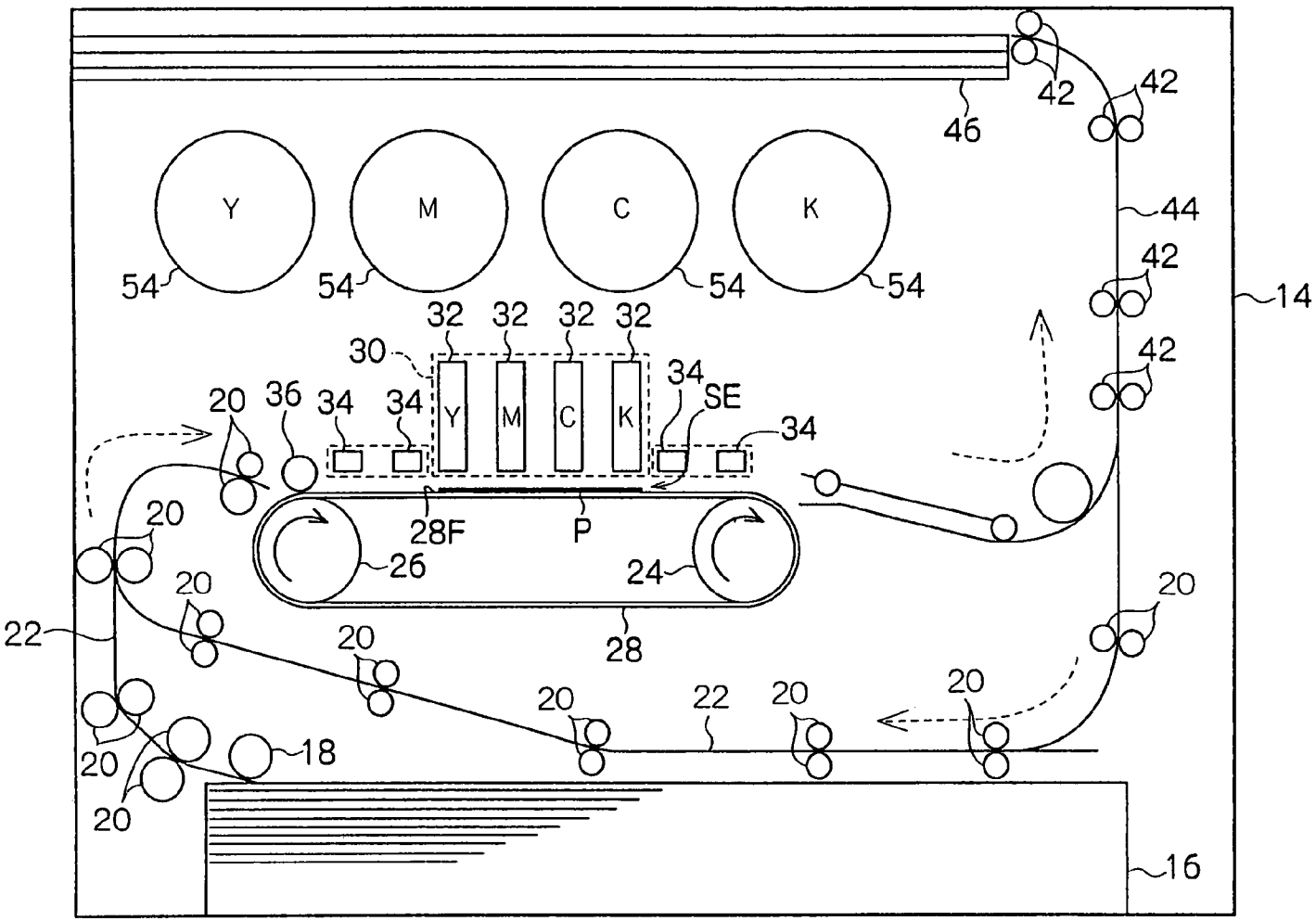
FIG. 1 is a schematic view showing a state of the structure of an inkjet recording apparatus according to an embodiment of the present invention.

Description will now be made of a first embodiment of the present invention with reference to the drawings Referring to FIG. 1, there is shown an inkjet recording apparatus 12 according an embodiment of the present invention wherein a paper feed tray 16 is provided on a bottom portion within a housing 14 such that paper P layered in the paper feed tray 16 can be taken out therefrom on a per sheet basis by a pickup roll 18. The paper P taken out is conveyed by means of plural conveyor roller pairs 20 forming a predetermined conveyance path 22.

Above the paper feed tray 16 is provided an endless conveyor belt 28 entrained about a driving roll 24 and a driven roll 26. Further, above the conveyance belt 28 is provided a recording head array 30 which is disposed in opposing relationship to a flat portion 28F of the conveyor belt 28. This region in which the recording head array is in opposition to the flat portion 28F of the conveyor belt 28 is an ejection region SE in which ink droplets are ejected from the recording head array 30. The paper P conveyed along the conveyance path 22 reaches the ejection region SE in a state that is supported on the conveyance belt 28, and thereupon ink droplets corresponding to image information are ejected from the recording head unit 30 so as to adhere to the paper P while the latter is placed in opposing relationship to the recording head array 30.

In the present embodiment, the recording head array 30 is formed in an elongated shape that has an effective recording region longer than the width of the paper P (the size of the paper in a direction perpendicular to the conveying direction) and structured such that four inkjet recording head units 32 (hereinafter, referred to simply as head units) corresponding to four colors such as yellow (Y), magenta (M), cyan (S), and black (K) respectively are arranged along the conveying direction, whereby a full-color image can be recorded.

Each head unit 32 is controlled by an unillustrated recording head control unit. The recording head unit is structured such that it determines a timing with which ink droplets are ejected in accordance with image information as well as which ink ejecting ports (nozzles) to be used and transmits a driving signal to the head units 32.

Further, the recording head array 30 may be structured so as to be immovable in a direction perpendicular to the conveying direction, but with a structure in which the recording head array 30 is movable as occasion demands, it is possible to record a higher-resolution image by multipath image recording, and it is also possible to prevent trouble with the head units from being reflected in a resultant recording.

Figure 2:
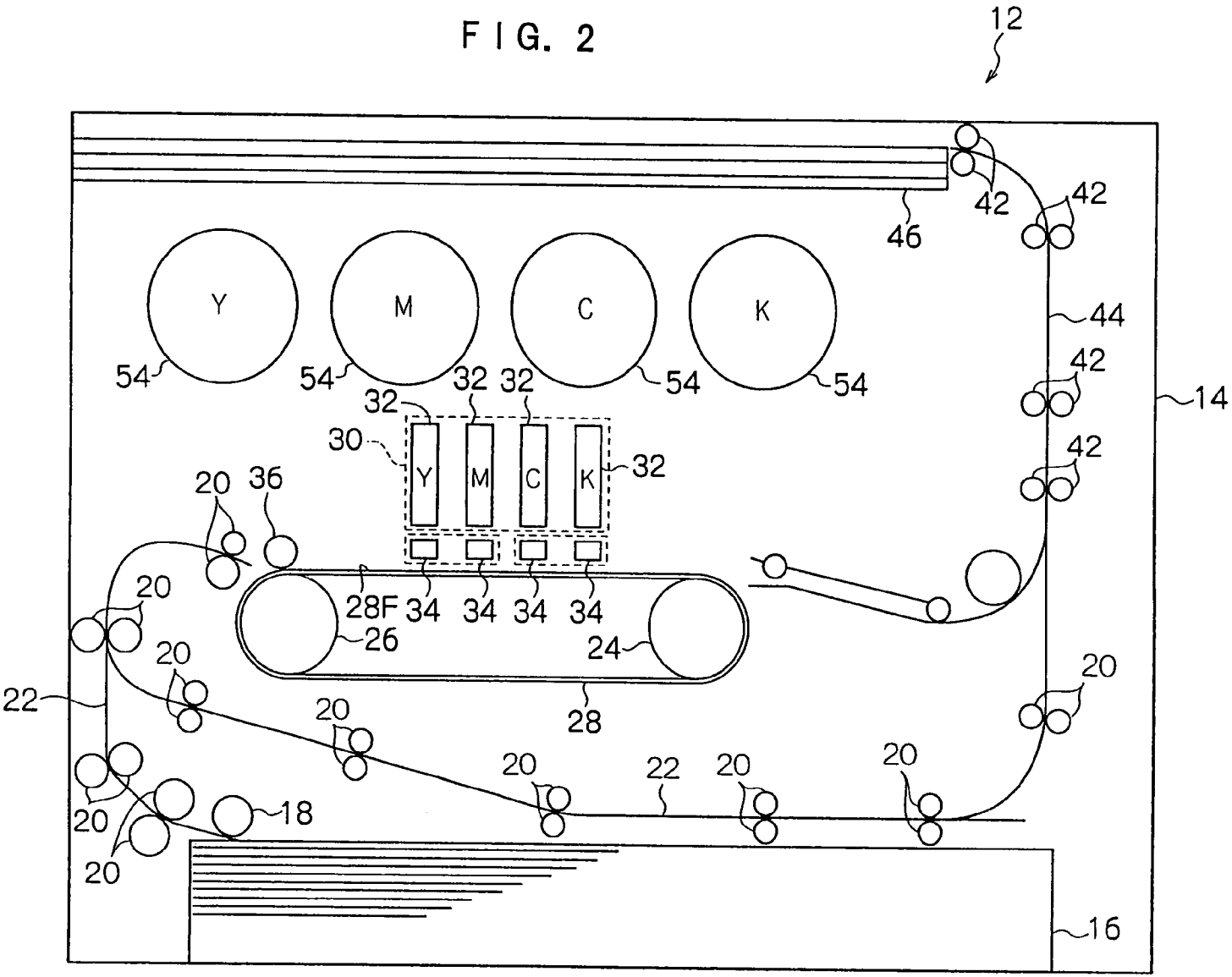
FIG. 2 is a schematic view showing another state of the structure of an inkjet recording apparatus according to another embodiment of the present invention.

On the opposite sides of the recording array 30, four maintenance units 34 corresponding to the head units 32 respectively are provided, two on each side. As shown in FIG. 2, when carrying out maintenance with respect to the head units 32, the recording head array 30 is moved upward, and the maintenance units 34 are moved so as to get into a gap defined between the recording head array 30 and the conveyor belt 28. Thus, the maintenance units 34 perform a predetermined maintenance operation (sucking, wiping, capping or the like) in a state that is in opposition to a nozzle surface 32N (see FIG. 3).

Figure 3:
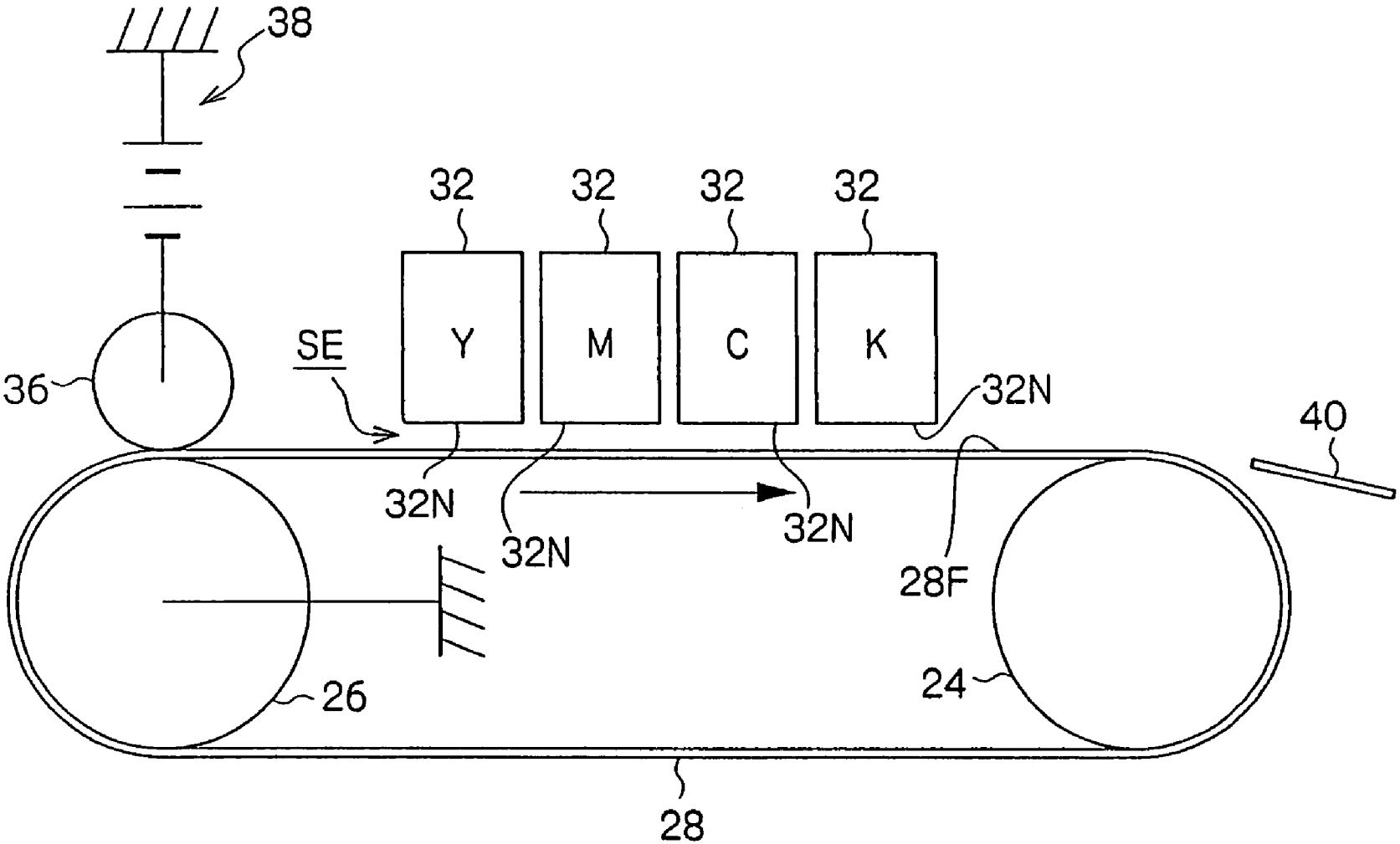
FIG. 3 is a schematic view showing a printing section of an inkjet recording apparatus according to an embodiment of the present invention.

As shown in FIG. 3, a charging roll 36 connected to a power source 38 is provided at the upstream side of the recording head array 30. The charging roll 36, with the conveyor belt 28 and the paper P being held between it and the driven roll 26, is movable between a pressing position where it presses the paper P against the conveyor belt 28 and a spacing position where it is spaced apart from the conveyor belt 28. At the pressing position, due to the fact that a potential difference occurs between the charging roll 36 and the driven roll 26 which is grounded, charges are applied to the paper P so that the paper P can be electrostatically attracted and attached to the conveyor belt 28.

At a downstream side of the recording head array 30, a removing plate 40 is provided which causes the paper P to be removed from the conveyor belt 28. The paper P thus removed is conveyed by a plurality of discharge roller pairs 42, forming a discharge path at a downstream side of the removing plate 40, and discharged to a catch tray 46 provided at a top portion of the housing 14.

Here, description will be made of the structure of the head units 32. Meanwhile, only one head unit 32 will be illustrated and described herein since all of the head units 32 have a similar structure.

Figure 4:
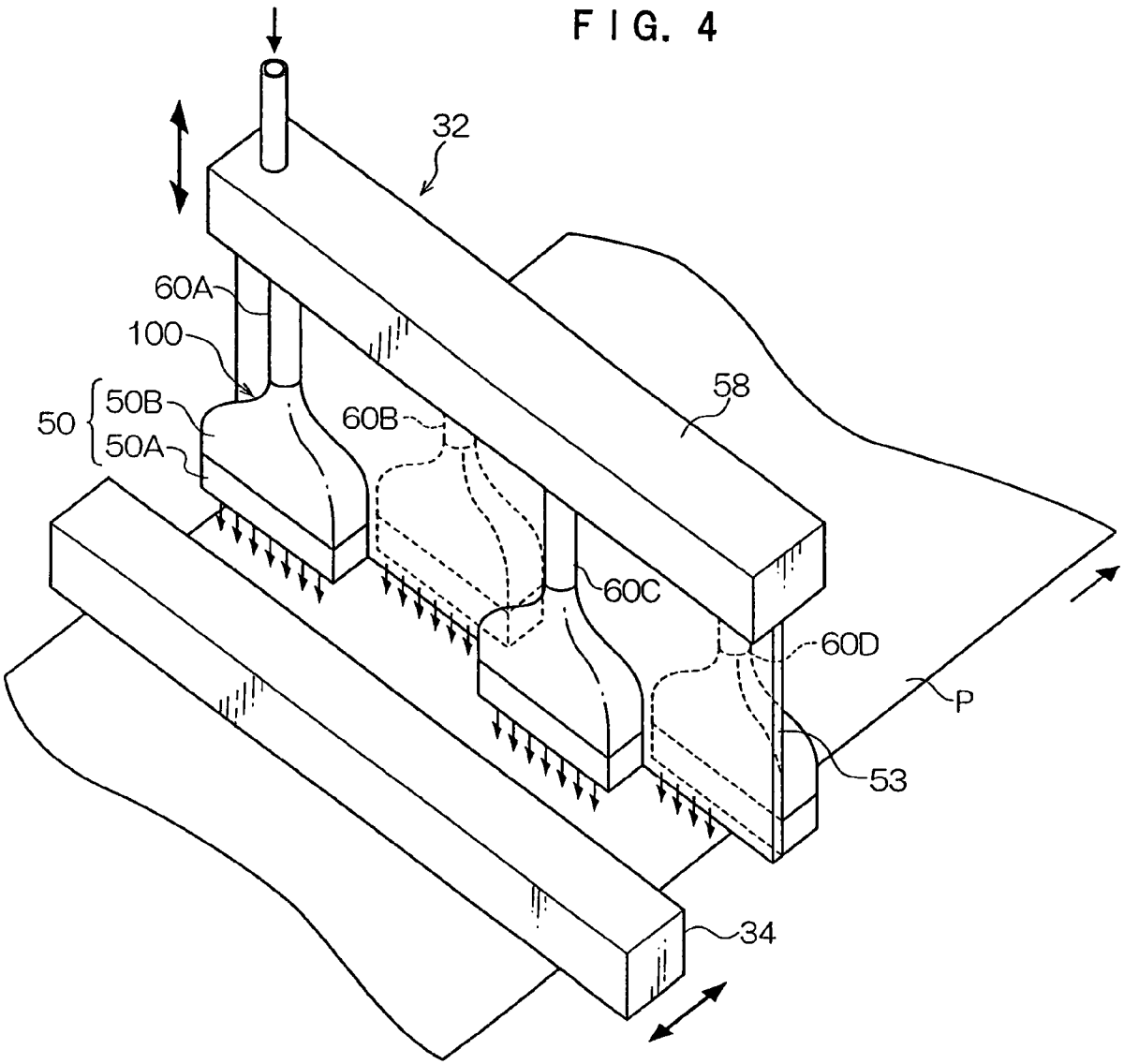
FIG. 4 is a perspective view showing an inkjet recording head unit according to an embodiment of the present invention.
Figure 5:
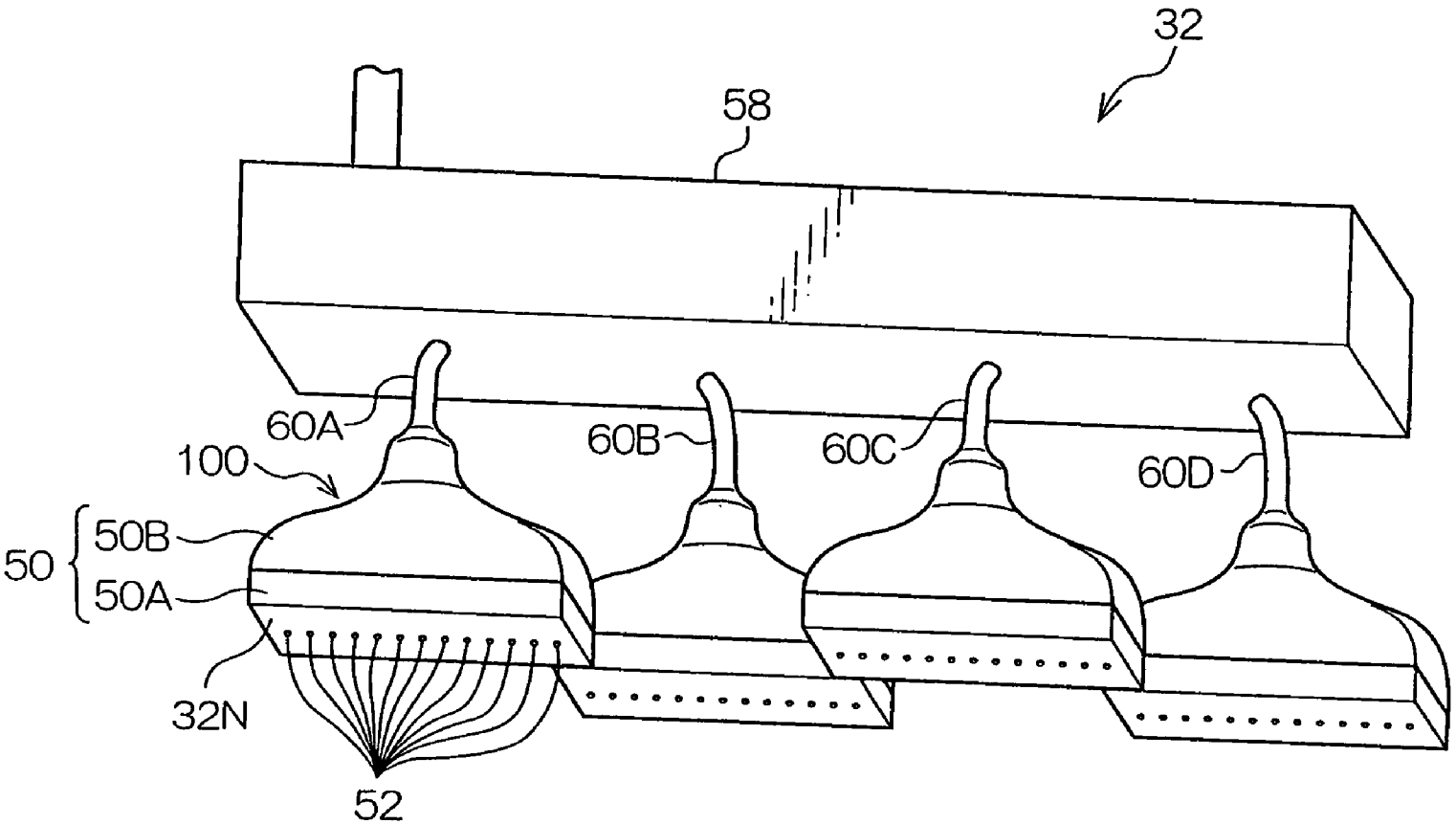
FIG. 5 is a perspective view, as viewed from a different direction, showing an inkjet recording head unit according to an embodiment of the present invention.

As shown in FIGS. 4 and 5, the head unit 32 is structured such that a plurality of (four in this embodiments) inkjet recording head sub-units (hereinafter, referred to simply as "sub-units"), each provided with an array of plural nozzles 52 extending widthwise of the paper P (in a direction perpendicular to the conveying direction), are arrayed widthwise of the paper P. The sub-units 50 are mounted to and arrayed in a zigzag manner on one or other surface of a support plate 53.

Each of the sub-units 50 is structured of an ink ejecting portion 50A, in which an ink flow path and a pressure chamber are defined by an unillustrated nozzle plate, flow path plate, vibration plate and so forth which are layered together, and an ink feeding portion 50B mounted on the ink ejecting portion 50 in communication with the ink flow path of the ink ejecting portion 50A. Piezoelectric elements are attached to the vibration plate of the ink ejecting portion 50A in correspondence to the respective pressure chambers.

Figure 6A:
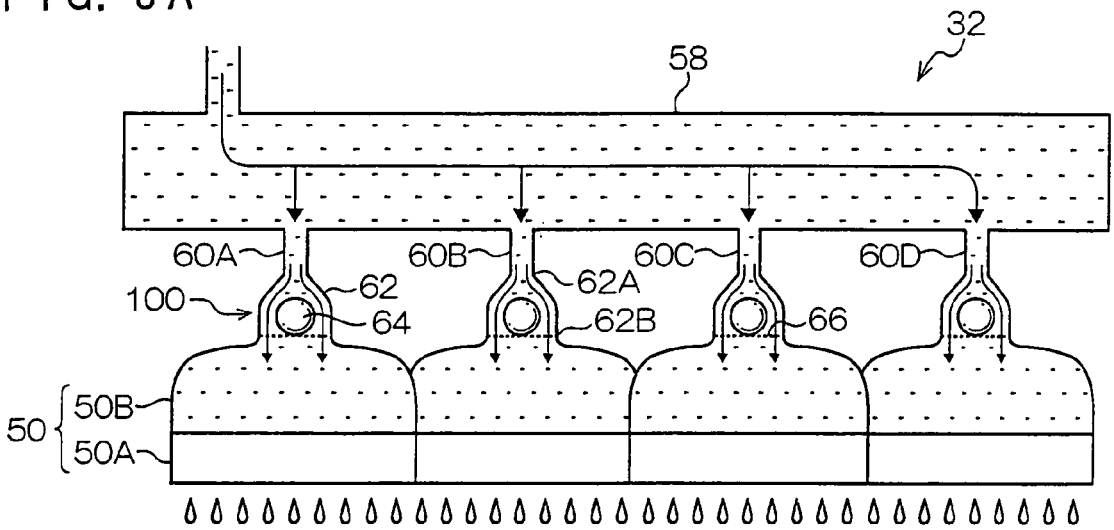
FIGS. 6A-6C are side views showing an inkjet recording head unit according to an embodiment of the present invention.

Further, an ink feed path 58 extending widthwise of the paper P is mounted on the top of the support plate 53. The ink feed path 58 is connected to an ink tank 54 (see FIG. 1) Furthermore, branched out of the ink feed path 58 are four ink feed path branches 60A-60D which extend downward from the bottom portion of the ink feed path and are connected to the top portion of the ink feed portion 50B of each sub-unit 50. That is, as shown in FIG. 6A, the inks fed from the ink tanks 54 are allowed to flow through the common ink feed path 58 and then are branched into the respective ink feed path branches 60A-60D so as to flow into the ink feed portion 50B of each sub-unit 50.

Figure 6B:
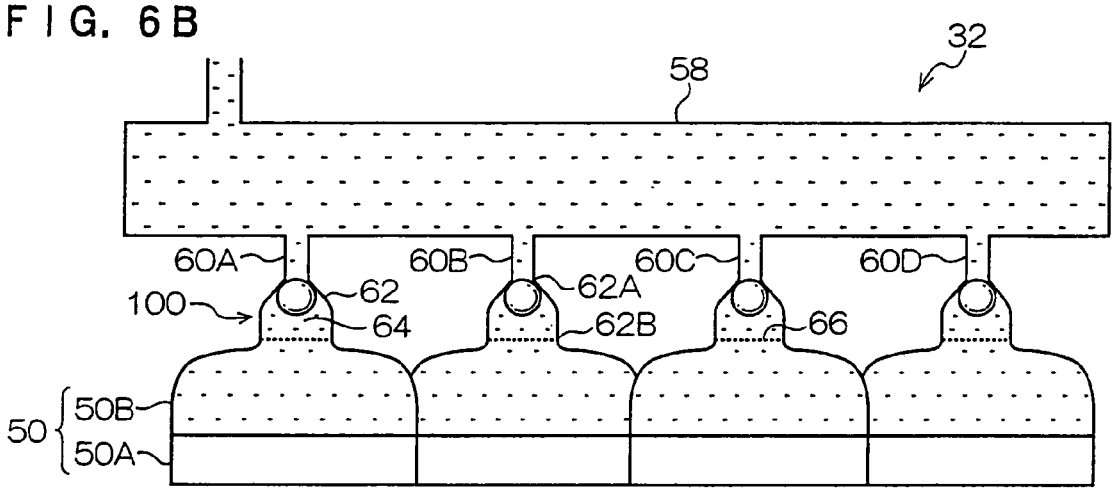
Figure 6C:
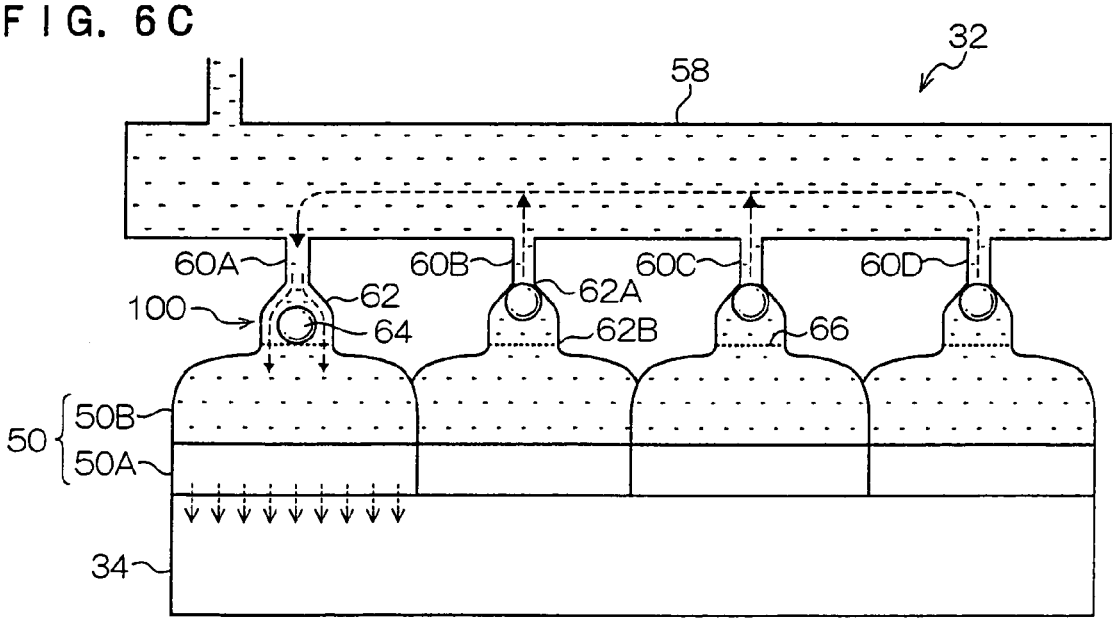

At this point, as shown in FIG. 6C, the maintenance unit 34 performs suctioning on a per sub-unit 50 basis during a maintenance operation. For this reason, while the ink is being suctioned from the nozzles of one sub-unit 50, a suctioning pressure acts on the other three sub-units 50 which are not subjected to suctioning, via the ink feed path 58, so that the ink in the other sub-units 50 is caused to flow backward. Further, if the backward flow of the ink in the sub-units 50 cause the pressure in the sub-unit 50 to be reduced down to a negative pressure sufficient to destroy a meniscus (ink surface) formed at the nozzles 52, then air is sucked in from the nozzles 52 so that air bubbles are caused to occur in the sub-unit 50.

Figure 7:
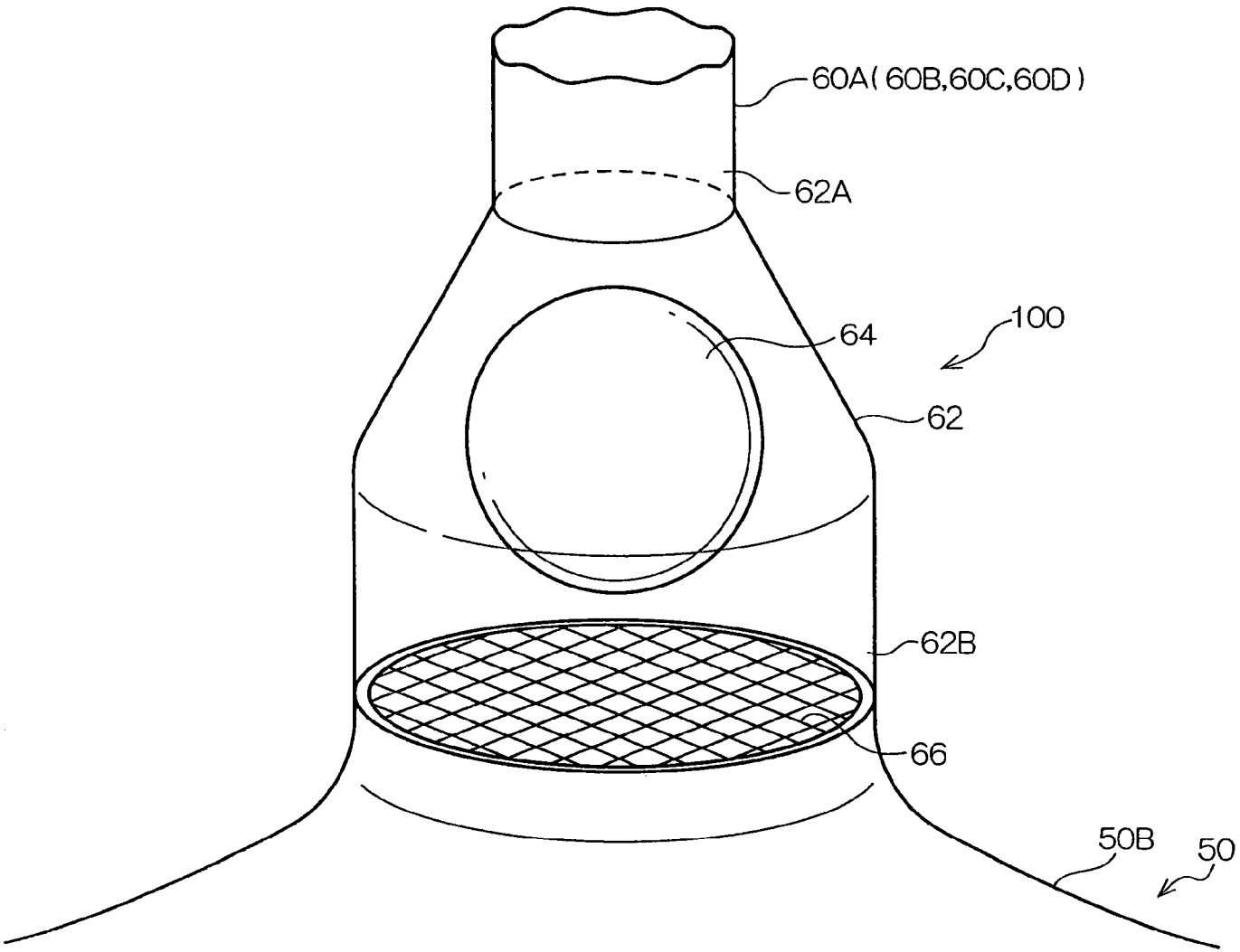
FIG. 7 is a perspective view showing a valve of an inkjet recording head unit according to a first embodiment of the present invention.

Therefore, in this embodiment, a valve 100 is provided in a connection portion between the respective sub-unit 50 and the ink feed path branches 60A-60D, thereby preventing occurrence of air bubbles in the sub-unit 50. As shown in FIG. 7, a valve body 62 of the valve 100 is provided at the top with a circular inlet port 62A, through which ink flows in from the ink feed path branches 60A-60D, and at the bottom, coaxially with the inlet port 62A, with a circular outlet port 62B, through which the ink that has flowed in from the inlet port 62A flows out to the sub-unit 50.

Further, a floating member 64 (whose specific gravity is 0.95) having a diameter larger than that of the inlet port 62A and smaller than that of the outlet port 62B, and a specific gravity smaller than that of the ink (whose gravity is 1.01), is floated in the ink in the valve body 62.

Further, the outlet port 62B of the valve body 62 is provided with a mesh-like opening member 66. This opening member 66 is formed on its entire surface with apertures having a diameter smaller than that of the floating member 64 and arranged in a crisscross pattern such that the ink is allowed to pass through the opening member 66 and the floating member 64 is stopped at the outlet port 62B by the opening member 66.

Figures 8A, 8B:
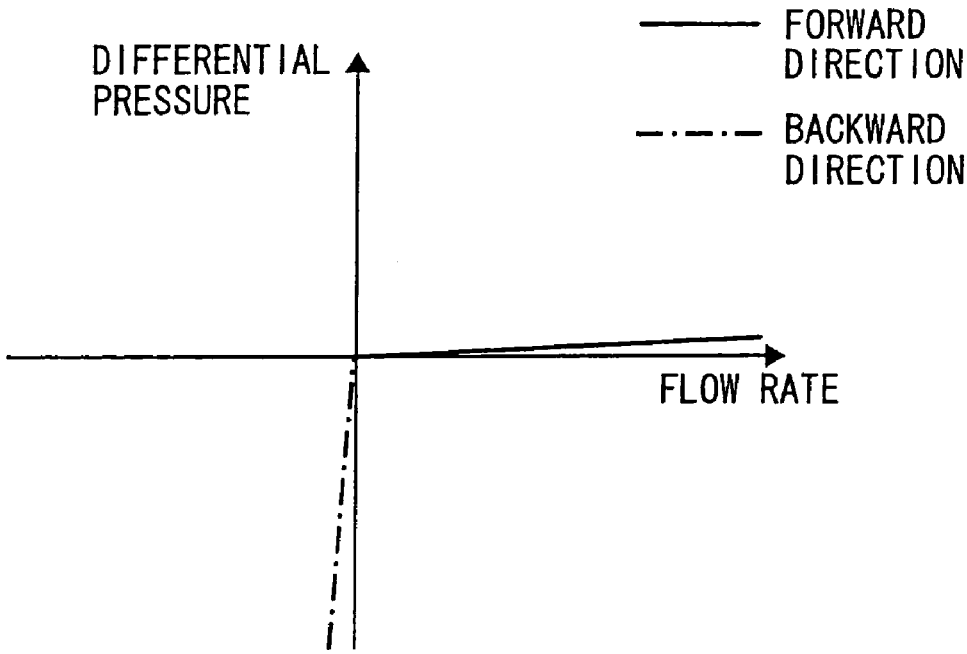
FIG. 8A is a table showing a flow path resistance when ink passes through the valve of the inkjet recording head unit according to the embodiment of the present invention.
FIG. 8B is a graph showing a relationship between a differential pressure and a flow rate before and after the valve.

In the above structure, as shown in FIG. 6A, when the ink is fed from the ink feed path branches 60A-60D to the sub-unit 50, the floating member 64 is moved toward the outlet port 62B due to the flow of the ink and thus the inlet port 62A is opened. In this case, loss of the ink pressure is small since the floating member 64 is simply floating in the ink. A result obtained by measuring the flow path resistance of the valve 100 is shown in the table of FIG. 8A, and relationships between the differential pressure and the flow rate before and after the valve 100 are shown in the graph of FIG. 8B, from which it can be seen that when the ink flows in a positive direction, the flow path resistance is negligibly small and the operational pressure with which the valve 100 is opened is also extremely low, i.e., as low as 1 mm $H_2O$. Thus, it is possible to stabilize the ink droplet ejecting performance.

Further, as shown in FIG. 6B, when the sub-unit 50 is fully filled with ink, the buoyant force of the floating member 64 is increased so as to close the inlet port 62A. Due to the fact that the valve body 62 is increased in diameter in a tapered manner from the inlet port 62A toward the outlet 62B and the floating member has a spherical shape, when the valve 100 is closed the floating member 64 is guided to the inlet port 62A by the tapered surface of the valve body 62 so as to be placed in close contact with the tapered surface. Thus, the inlet port 62A can be closed with certainty using the floating member 64.

For this reason, as shown in FIG. 6A, when a suctioning operation is started at one sub-unit 50, the valves 100 of the remaining three sub-units 50, which do not perform suctioning, have already closed and represent as high a flow path resistance as $4.0\times10^{11}$ N·sec/$m^5$ against the backward ink flow; thus, there occurs no backward flow of the ink, such as to destroy meniscuses formed in the nozzles 52 during the suctioning operation. That is, since there is no time lag between a point of time when the suctioning operation is started and a point of time when the valve 100 is closed, it is possible to prevent occurrence of air bubbles in the remaining three sub-units 50 during the suctioning operation.

Accordingly, when the suctioning operation is started, the valves 100 of the remaining sub-units 50 which do not perform suctioning are substantially instantaneously closed, backward flow of the ink and occurrence of air bubbles can be suppressed remarkably as compared with the prior art.

Further, in the present embodiment, the valve 100 and the floating member 64 are formed of a resin material. Thus, it is not necessarily the case that the valve 100 provides a completely sealed state between the sub-unit 50 and the ink flow path branches 60A-60D; therefore, it is possible to prevent the internal pressure of the head unit 32 from being increased due to variations in the environment, and it is also possible to prevent bursting of the unit and leakage of the ink.

Next, description will be made of a second embodiment of the present invention. Meanwhile, parts similar to those of the first embodiment will be indicated by like reference numerals, and a further description thereof will be omitted.

Figure 9:
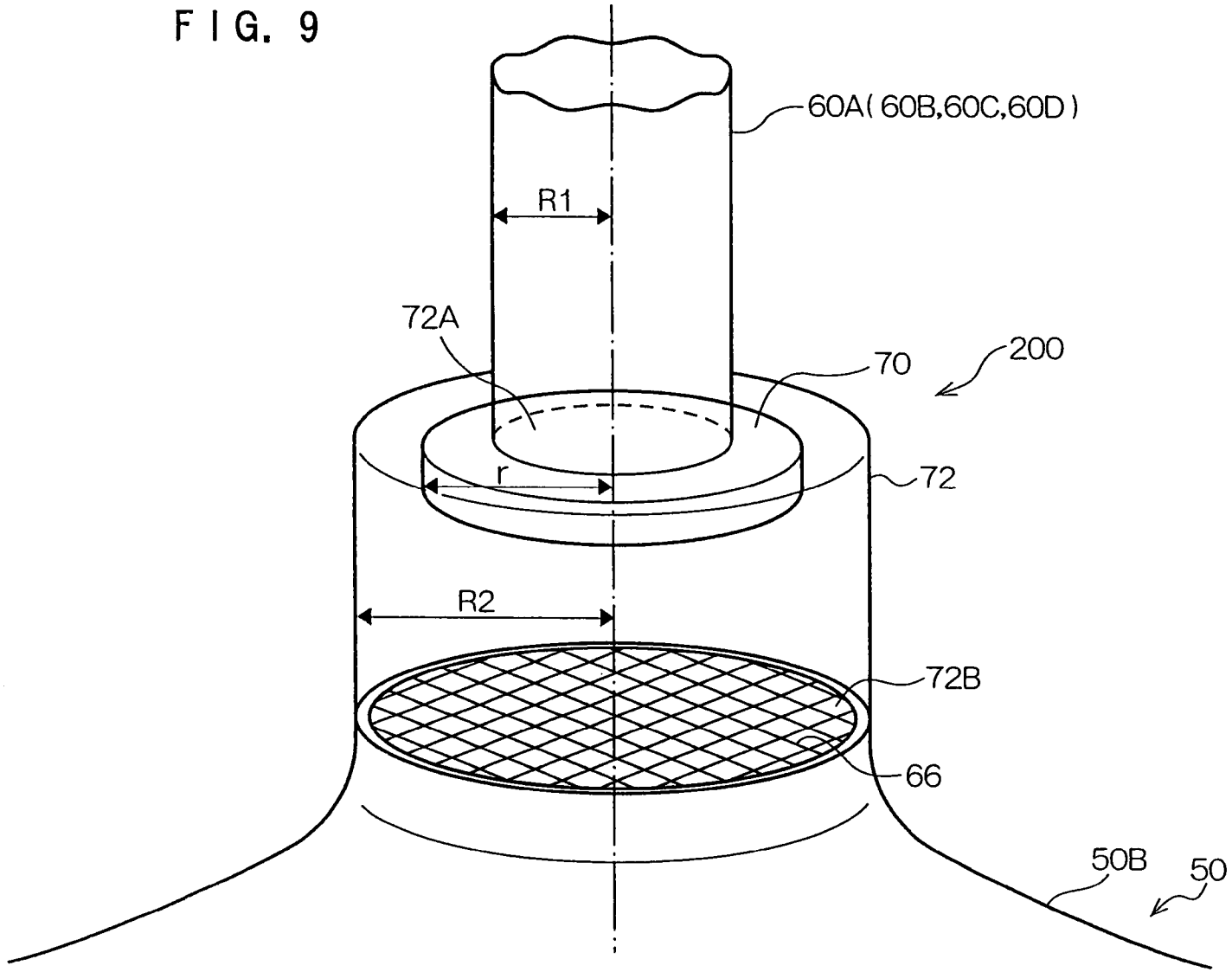
FIG. 9 is a perspective view showing a valve of an inkjet recording head unit according to a second embodiment of the present invention.

As shown in FIG. 9, a valve 200 includes a floating member 70 in the form of a disk having a diameter larger than that of an inlet port 72A and smaller than that of an outlet port 72B. Further, a valve body 72 is of a substantially cylindrical shape having a radius of R2. The inlet port 72A formed in the upper end center portion of the valve body 72 has a radius R1 (<R2) smaller than the radius R2 of the valve body 72, and the outlet port 72B has a radius substantially equal to the radius R2 of the valve body 72 such that the radius is expanded in a stepwise manner between the inlet port 72A and the outlet port 72B.

Here, in order to close the inlet port 72A with the floating member 70 shifted from the center of the valve body 72, it is required that the diameter 2*r* of the floating member 70 be larger than (2R1+(R2−R1)) which is a sum of the diameter 2R1 of the inlet port 72A and the distance (R2−R1) from the circumference of the inlet port 72A to the radial end portion of the valve body 72.

That is, it is required that the following relational expression (1) be satisfied:

$$2r>(2R1+(R2-R1)$$

$$r>(2R1+(R2-R1)/2 \quad (1)$$

Thus, in the present embodiment, the radius R1 of the inlet port 72A, the radius R2 of the outlet port 72B, and the radius r of the floating member 70 are set so as to satisfy the above relational expression (1). By so doing, it is possible to close the valve 200 with certainty when the ink flows backward, thereby preventing occurrence of air bubbles.

Next, description will be made of a third embodiment of the valve according to the present invention. Meanwhile, parts similar to those of the first and second embodiments will be indicated by like reference numerals, and a further description thereof will be omitted.

Figure 10:
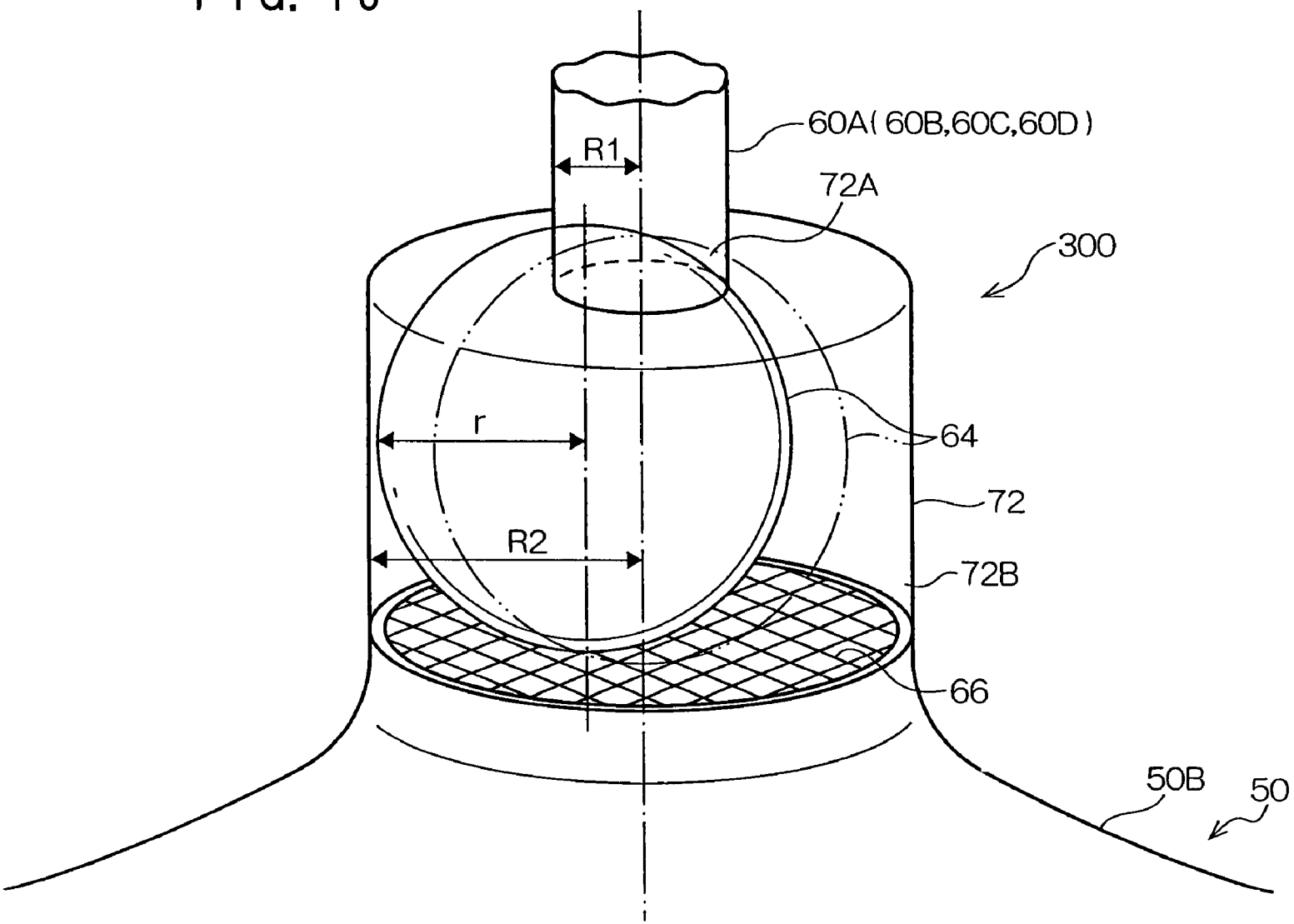
FIG. 10 is a side view showing a valve of an inkjet recording head unit according to a third embodiment of the present invention.

Referring to FIG. 10, there is shown a valve 300 according to this embodiment, wherein a floating member 64 of a spherical shape having a radius of r is floating in a valve body 72, in which the radius is expanded in a stepwise manner from an inlet port 72A having a radius of R1 to an outlet port 72B having a radius of R2.

Here, in order to cause the floating member 64 shifted from the center of the valve body 72 to be displaced to the center of the inlet port 72A so as to close the inlet port 72A with the floating member 64, as indicated by a solid line, it is required that the radius r of the floating member 64 be larger than the distance from the circumference of the inlet port 72A to the radial edge portion of the valve body 72 (R2−R1). That is, it is required that the following relational expression (2) be satisfied:

$$r>(R2-R1) \quad (2)$$

Thus, in the present embodiment, the radius R1 of the inlet port 72A, the radius R2 of the outlet port 72B, and the radius r of the floating member 64 are set so as to satisfy the above relational expression (2). By so doing, it is possible to close the valve 300 with certainty when the ink flows backward, thereby preventing occurrence of air bubbles.

Next, description will be made of a fourth embodiment of the valve according to the present invention. Meanwhile, parts similar to those of the first to third embodiments will be indicated by like reference numerals, and a further description thereof will be omitted.

Figure 11:
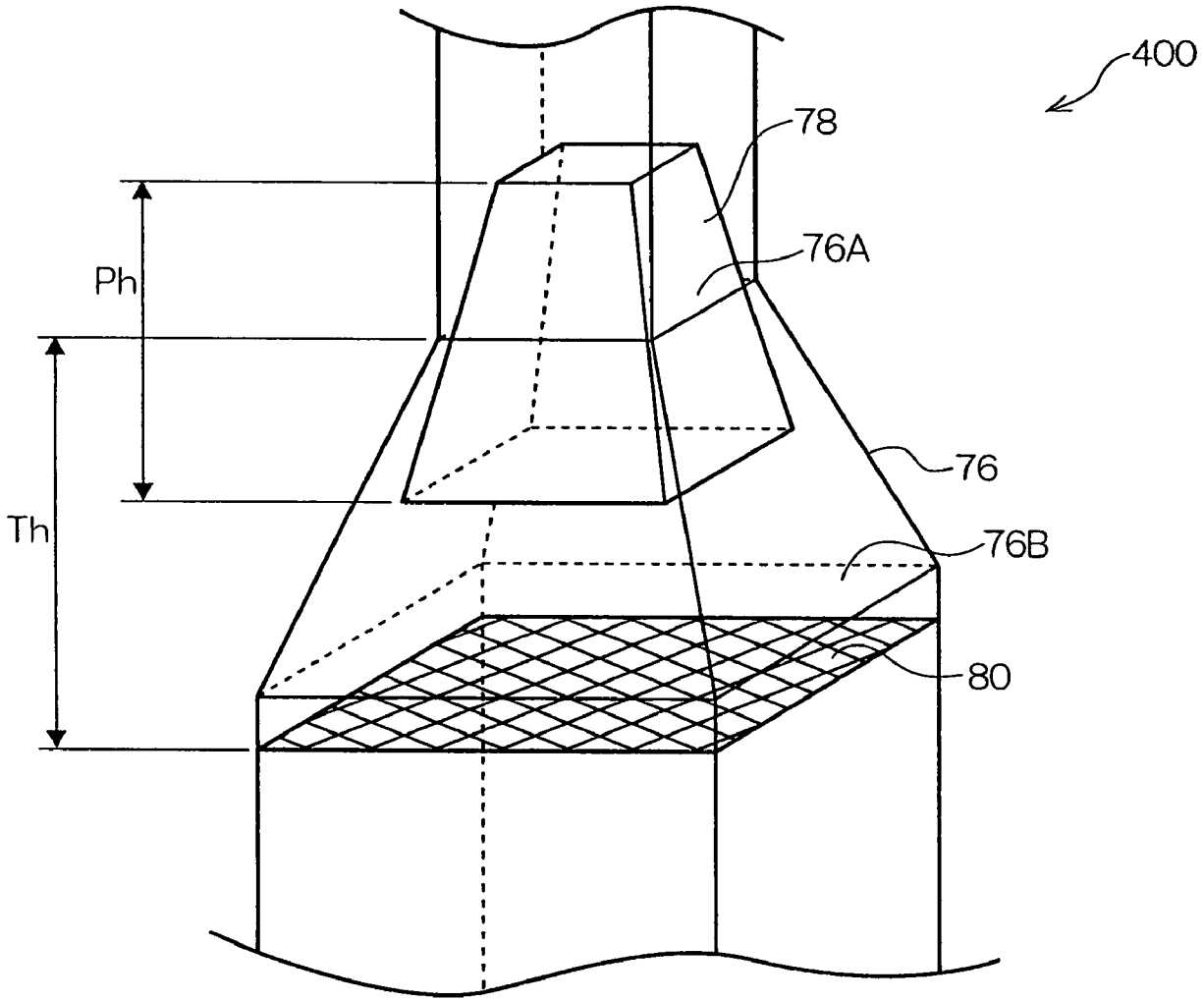
FIG. 11 is a side view showing a valve of an inkjet recording head unit according to a fourth embodiment of the present invention.

Referring to FIG. 11, there is shown a valve 400 according to this embodiment, wherein a truncated pyramid-shaped floating member 78 having a specific gravity lower than that of the ink is floated in a truncated pyramid-shaped valve body 76 in which the cross-section area expands from a rectangular inlet port 76A to a rectangular outlet port 76B. A rectangular opening member 80 is provided at the outlet port 76B of the valve body 76, thereby preventing the floating member 78 from flowing out of the outlet port 76B The larger end portion of the floating member 78 has an area larger than that of the inlet port 76A, while the smaller end portion of the floating member 78 has an area smaller than that of the inlet port 76A. Further, the height Ph of the floating member 78 is higher than the height Th of the valve body 76 (the distance from the inlet port 76A to the opening member) so that the floating member 78 is prevented from rotating top to bottom in the valve body 76. Further, the sectional configuration of the floating member 78 conforms to that of the inlet port 76A such that the floating member 78 can be fitted in the inlet port 76A.

That is, when the sub-unit 50 is fully filled with ink, the floating member 78 is moved upward due to buoyancy so as to close the inlet port 76A. For this reason, when suctioning is started in the sub-unit 50, the valve 400, of each of the other three sub-units in which suctioning is not performed, is closed so that no backward flow of the ink occurs. Thus, since there is no time lag from a point of time when suctioning is started to a point of time when the valves 400 are closed, occurrence of air bubbles in the remaining three sub-units can be prevented during the suctioning operation.

Next, description will be made of a fifth embodiment of the valve according to the present invention. Meanwhile, parts similar to those of the first to fourth embodiments will be indicated by like reference numerals, and a further description thereof will be omitted.

Figure 12:
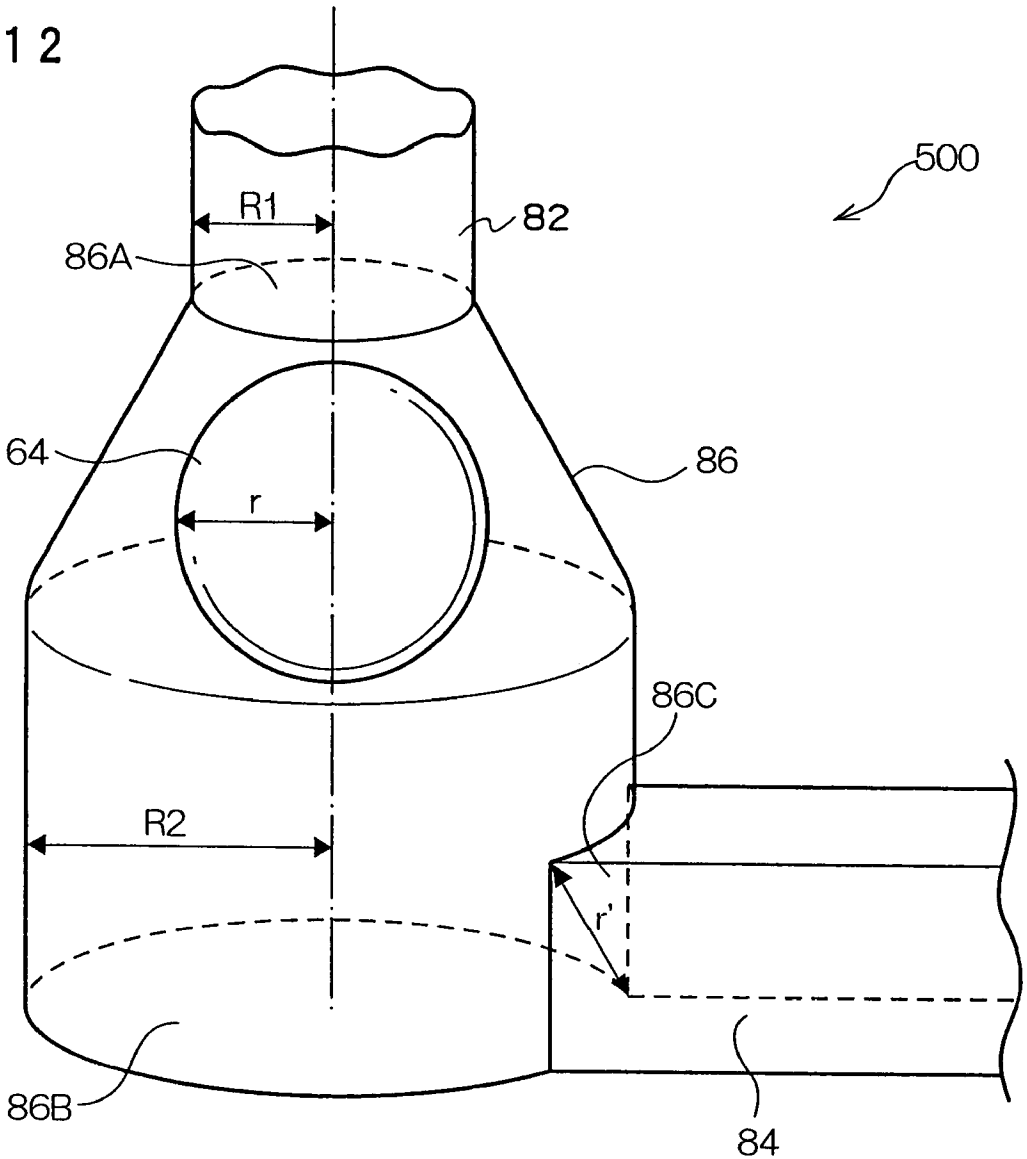
FIG. 12 is a side view showing a valve of an inkjet recording head unit according to a fifth embodiment of the present invention.

Referring to FIG. 12, there is shown a valve 500 according to this embodiment, wherein a vertically extending inlet pipe 82 and a horizontally extending outlet pipe 84 are connected thereto. A valve body 86 is structured such that the radius thereof increases from an inlet port 86A to a bottom surface 86B, and an outlet port 86C is formed through the side wall of the valve body 86 with the outlet pipe 84 coupled to the outlet port 86C.

In the present embodiment, the coupling portion between the outlet pipe 84 and the outlet port 86C has a rectangular sectional shape such that the height and/or width of the section is smaller than the radius r of the floating member 64. In other words, the configuration of the coupling portion between the outlet pipe 84 and the outlet port 86C does not conform to that of the sectional configuration of the floating member 64 in such that the floating member 64 would tend to get stuck in the coupling portion. For this reason, the output pipe 84 will not be closed by the floating member 64 and, when the ink is permitted to flow from the outlet pipe 84 to the sub-unit 50, the floating member 64 is restrained by the bottom surface 86B and outlet port 86C of the valve body 86, so as to be prevented from flowing out from the outlet port 84.

Next, description will be made of a sixth embodiment of the valve according to the present invention. Meanwhile, parts similar to those of the first to fifth embodiments will be indicated by like reference numerals, and a further description thereof will be omitted.

Figure 13:
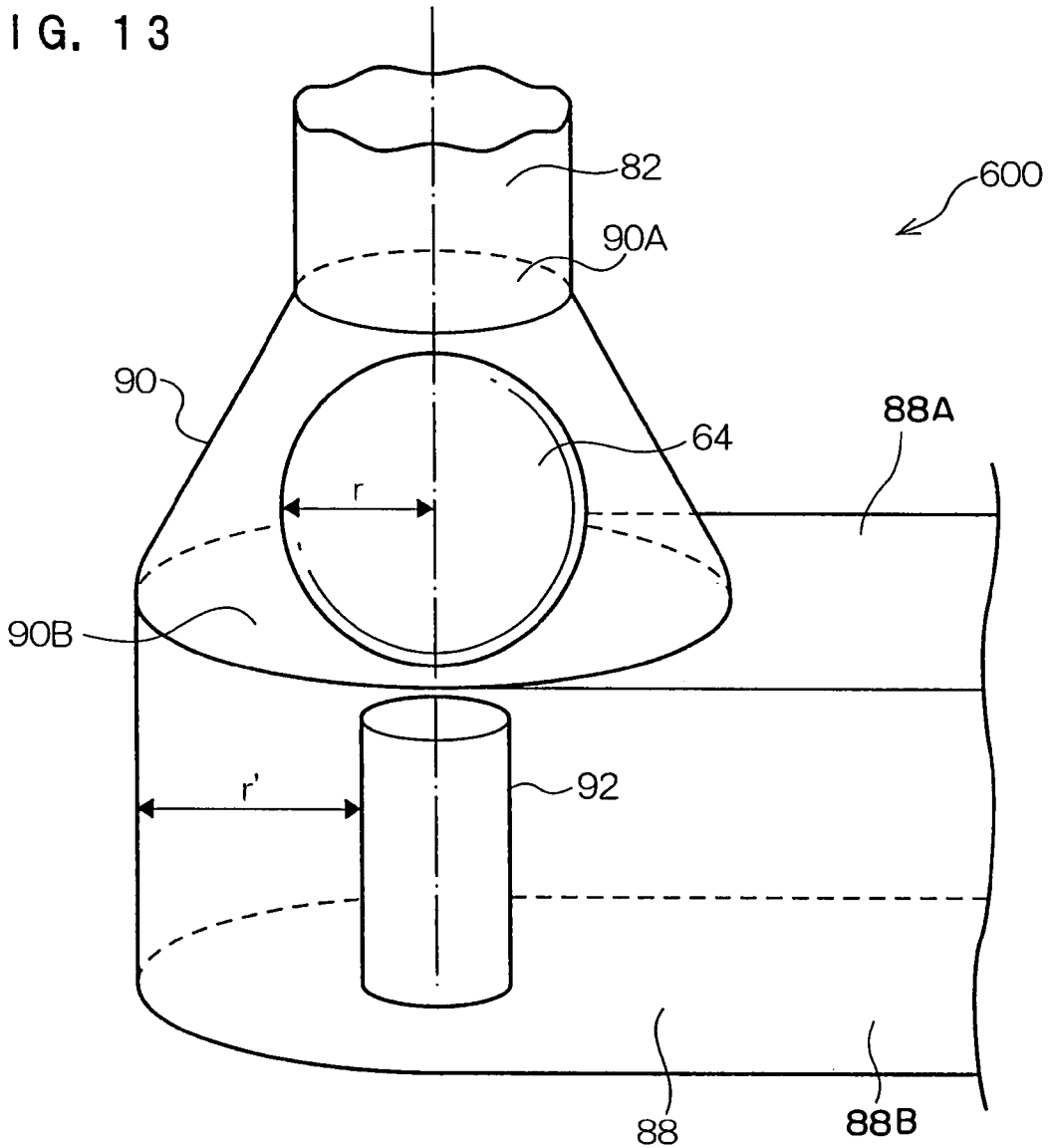
FIG. 13 is a side view showing a valve of an inkjet recording head unit according to a sixth embodiment of the present invention.

Referring to FIG. 13, there is shown a valve 600 according to this embodiment wherein a vertically extending inlet pipe 82 and a horizontally extending outlet pipe 88 are connected thereto. A valve body 90 is structured such that the radius increases from an inlet port 90A to an outlet port 90B. The outlet pipe 88 is a pipe conduit having a rectangular sectional shape in which the outlet port 90B is coupled to a top surface 88A thereof and a protruding member 92 protruding toward a radial center portion of the outlet port 90B is standingly provided on a bottom surface thereof.

The distance r' from the protruding member 92 to the circumference of the outlet port 90B is set to be smaller than the radius r of the floating member such that the floating member 64 is prevented from flowing from the outlet port 90B into the outlet pipe 88.

Although in the first to sixth embodiments, description has been made of the example in which the present invention has been applied to an inkjet recording apparatus, it is to be understood that the present invention is by no means limited thereto and is equally applicable to any type of apparatus including a substantially vertically extending fluid flow path.

Further, in order to increase improve the close contact between valve body and the floating member and thereby increase the resistance against backward flow of the ink, the valve body and/or the floating member may be formed of an elastic material.

Further, although in the first, third, fifth and sixth embodiments, the floating member 64 has been exemplified as a spherical member, it should be understood that the configuration of the floating member 64 is not limited thereto, and that any member having a sectional configuration conforming to that of the valve inlet (such, for example, as a conical configuration) may be used as the floating member.

Further, the valve according to the present invention is not required to be placed in a vertically oriented manner but may be placed tilted to an extent such that a state can be established in which the inlet port is closed every time as a result of the floating member being moved upward due to buoyancy. For example, in the first embodiment, it is possible that the valve may be tilted up to the extent that the tapered surface becomes substantially horizontal.

Further, the valve according to the present invention can be applied not only an liquid droplet ejecting unit having an actuator, for example a piezoelectric element, but also an liquid droplet ejecting unit having a heater so as to make a bubble to eject the liquid droplet.

Further, the liquid droplet ejecting unit can be applied not only to an inkjet recording head unit but also a liquid droplet ejecting unit in general that is adapted for various industrial applications, such as fabricating a color filter for displays by ejecting colored ink onto a polymeric film or a glass sheet; forming a bump for mounting a component by ejecting molten solder onto a substrate; forming an EL display panel by ejecting an organic EL solution onto a substrate; forming a bump for electrical mounting by ejecting molten solder onto a substrate; and so forth.

Further, the "recording medium" on which an image is recorded using the liquid droplet ejecting unit and image forming apparatus according to the present invention includes a wide range of media onto which liquid droplets can be ejected by the liquid ejecting unit. Accordingly, it goes without saying that the recording medium includes a recording paper, an OHP sheet or the like, and in addition, it also includes a substrate on which a wiring pattern or the like is formed.

While in the foregoing, the present invention has been illustrated and described with respect to some specific embodiments thereof, it is to be understood that the prevent invention is by no means limited thereto and encompasses all changes and modifications which will become possible without departing from the spirit and scope of the present invention.

What is claimed is:

1. A liquid droplet ejecting unit comprising:

plural liquid droplet ejecting sub-units arrayed in a direction substantially perpendicular to a conveying direction of a recording medium, each of the liquid droplet ejecting sub-units being structured such that a liquid is fed thereto via a common liquid feed path and droplets of the liquid are ejected from nozzles onto the recording medium; and plural valves that connect the respective liquid droplet ejecting sub-units and the liquid feed path;

wherein each of the valves comprises a valve body provided at an upper side with an inlet port into which the liquid flows from the liquid feed path and at a lower side with an outlet port from which the liquid that flows into the inlet port from the liquid feed path flows out to the liquid droplet ejecting sub-unit, the outlet port being larger in cross-sectional size than the inlet port, and a floating member that is larger in cross-sectional size than the inlet port and smaller in cross-sectional size than the outlet port and has a lower specific gravity that the liquid such that the floating member floats in the liquid in the valve body and is capable of closing the inlet port.

2. The liquid droplet ejecting unit according to claim 1, wherein:

both the inlet port and the outlet port are substantially circular;

the valve body is structured such that the cross-sectional size gradually increases from the inlet port to the outlet port; and the floating member is substantially spherical.

3. The liquid droplet ejecting unit according to claim 1, wherein the valve body is configured such that: the inlet port is of a substantially circular shape having a radius of R1; the outlet port is substantially concentric with the inlet port and of a substantially circular shape having a radius of R2; and the floating member is of a substantially spherical shape having a radius of r; and wherein the radii r, R1 and R2 satisfy a relationship expressed by the formula:

$$r>(R2-R1).$$

4. The liquid droplet ejecting unit according to claim 1, wherein the valve body is configured such that the inlet port is of a substantially circular shape having a radius of R1; the outlet port is of a substantially circular shape having a radius of radius of R2; and the floating member is of a substantially disk-like shape having a radius of r; and wherein the radii r, R1 and R2 satisfy a relationship expressed by the formula:

$$r>(R1+R2)/2.$$

5. The liquid droplet ejecting unit according to claim 1, further comprising a flowing-out preventing member provided at the outlet port so as to prevent the floating member from flowing out of the outlet port.

6. The liquid droplet ejecting unit according to claim 5, wherein the flowing-out preventing member has formed over its entire surface plural apertures smaller in size than the flowing member.

7. The liquid droplet ejecting unit according to claim 5, wherein the flowing-out preventing member is formed by a protruding member provided at the outlet port.

8. An image forming apparatus comprising a liquid droplet ejecting unit which comprises:

plural liquid droplet ejecting sub-units arrayed in a direction substantially perpendicular to a conveying direction of a recording medium, each of the liquid droplet ejecting sub-units being structured such that a liquid is fed thereto via a common liquid feed path and droplets of the liquid are ejected from nozzles onto the recording medium; and plural valves that connect the respective liquid droplet ejecting sub-units and the liquid feed path;

wherein each of the valves comprises a valve body provided at an upper side with an inlet port into which the liquid flows from the liquid feed path and at a lower side with an outlet port from which the liquid that flows into the inlet port from the liquid feed path flows out to the liquid droplet ejecting sub-unit, the outlet port being larger in cross-sectional size than the inlet port, and a floating member that is larger in cross-sectional size than the inlet port and smaller in cross-sectional size than the outlet port and has a lower specific gravity that the liquid, such that the floating member is floats in the liquid in the valve body and is capable of closing the inlet port.

9. The apparatus according to claim 8, wherein:

both the inlet port and the outlet port are substantially circular;

the valve body is structured such that the radius is gradually increased from the inlet port to the outlet port; and the floating member is substantially spherical.

10. The apparatus according to claim 8, wherein the valve body is configured such that: the inlet port is of a substantially circular shape having a radius of R1; the outlet port is substantially concentric with the inlet port and of a substantially circular shape having a radius of R2; and the floating member is of a substantially spherical shape having a radius of r; and wherein the radii r, R1 and R2 satisfy a relationship expressed by the formula:

$$r>(R2-R1).$$

11. The apparatus according to claim 8, wherein the valve body is configured such that the inlet port is of a substantially circular shape having a radius of R1; the outlet port is of a substantially circular shape having a radius of radius of R2; and the floating member is of a substantially disk-like shape having a radius of r; and wherein the radii r, R1 and R2 satisfy a relationship expressed by a formula:

$$r>(R1+R2)/2.$$

12. The apparatus according to claim 8, wherein the liquid droplet ejecting unit further comprises a flowing-out preventing member provided at the outlet port so as to prevent the floating member from flowing out of the outlet port.

13. The apparatus according to claim 8, wherein the flowing-out preventing member has formed over its entire surface plural apertures smaller in size than the flowing member.

14. The apparatus according to claim 8, wherein the flowing-out preventing member is formed by a protruding member provided at the outlet port.

* * * * *